US006155165A

United States Patent [19]

Kaule

[11] Patent Number: 6,155,165

[45] **Date of Patent: *Dec. 5, 2000**

[54] ROTARY SCREEN PRINTING CYLINDER HAVING SEPARATED INK ZONES

[75] Inventor: Wittich Kaule, Emmering, Germany

[73] Assignee: Giesecke & Devrient GmbH, München, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/624,538

[22] PCT Filed: Aug. 11, 1995

[86] PCT No.: PCT/EP95/03199

§ 371 Date: May 2, 1996

§ 102(e) Date: May 2, 1996

[87] PCT Pub. No.: WO96/05058

PCT Pub. Date: Feb. 22, 1996

[30] Foreign Application Priority Data

Aug. 12, 1994 [DE] Germany ..... 44 28 670

[51] Int. Cl.[7] ..... B41L 13/06

[52] U.S. Cl. ..... 101/116; 101/119; 101/120

[58] Field of Search ..... 101/115, 116, 101/119, 120, 127, 127.1, 128, 128.1, 128.4, 129

[56] References Cited

U.S. PATENT DOCUMENTS

| | | | |
|---|---|---|---|
| 2,613,595 | 10/1952 | Weldon | 101/115 |
| 3,408,984 | 11/1968 | Pullins | 101/119 |
| 3,613,635 | 10/1971 | Brehm | 101/119 |
| 3,892,176 | 7/1975 | Van der Winden | 101/116 |
| 3,902,414 | 9/1975 | Zimmer et al. | 101/116 |
| 4,379,185 | 4/1983 | Smith et al. | 101/129 |
| 4,444,105 | 4/1984 | Mitter | 101/120 |
| 4,497,249 | 2/1985 | Mitter | 101/127.1 |
| 4,843,963 | 7/1989 | Hoeflein et al. | 101/128 |
| 4,878,127 | 10/1989 | Zollman et al. | 101/128.4 |

FOREIGN PATENT DOCUMENTS

| | | | |
|---|---|---|---|
| 267181 | 11/1987 | Japan | 101/116 |

OTHER PUBLICATIONS

Translation of Tanabe (JP 62–267,181), Nov. 1987.

*Primary Examiner*—Stephen R. Funk

*Attorney, Agent, or Firm*—Cohen, Pontani, Lieberman & Pavane

[57] ABSTRACT

A rotary screen printing cylinder including a cylindrical screen, a squeegee disposed within the screen, and two end pieces each fastened as an extension of the cylindrical surface of the screen. The screen cylinder has at least two zones which are provided with color-permeable openings at least in partial areas and are separated by a color-impermeable dead zone of predetermined width. The dead zone is designed so as to give the screen cylinder stability.

19 Claims, 3 Drawing Sheets

ROTARY SCREEN PRINTING CYLINDER HAVING SEPARATED INK ZONES

BACKGROUND OF THE INVENTION

1. Field of the Invention

The present invention relates to a rotary screen printing cylinder comprising a cylindrical screen having at least one zone provided with color-permeable openings at least in partial areas, a squeegee disposed within the screen, and two end pieces each fastened to an end of the screen as an extension of the cylindrical surface. The invention relates further to a system of such rotary screen printing cylinders and to a method for producing them.

2. Description of the Prior Art

In screen process printing, the color is pressed with the help of a squeegee through a stretched screen surface, generally a plastic or metal fabric of predetermined mesh width, the fabric being impervious to color in the nonprinting areas. The pores are usually blocked photographically by the screen material being coated with a photographic emulsion and exposed to the desired composition pattern. The exposed areas are washed away during the subsequent development of the emulsion so that the screen becomes color-permeable on the exposed areas.

Originally a screen printing unit comprises a metal or wooden frame over which the screen material is stretched without deformation. Due to the economic necessity of producing faster and more efficient printing machines one has developed rotary screen printing units which allow continuous printing of endless sheets. The screen is no longer flat but formed as a cylinder envelope inside which the color squeegee is fastened.

The cylindrical screen is produced for example by accordingly shaping a plastic or metal fabric which is subsequently welded along the cylindrical surface. However this weld causes problems during printing, so that rotary screen printing cylinders are very frequently electroplated as this production process obtains a uniform screen surface.

EP 0 164 149 describes such a production method. In this method an electroconductive screen master is placed in an electrolytic bath and connected with the cathode of a current transmitter. A metal layer is then deposited on the master, which is subsequently removed from the master and patterned. Prior to patterning the screen material has a uniform perforation which must be made color-impermeable in the nonprinting areas for printing. This is usually done with the help of the abovementioned photographic methods.

EP 0 338 612 A1 describes, for example, such a method for rotary screen printing cylinders. The screen likewise consists in this case of a perforated metal cylinder to which an end piece is glued as an extension of the cylindrical surface in each case prior to patterning. The rigidly mounted end pieces allow easy and quick replacement of the printing cylinder in the printing unit, which is of great benefit particularly with small print orders. Only after the connecting elements are glued to the screen is the latter coated with the photographic emulsion and exposed in the usual way. As soon as a new printing pattern is required the unexposed photographic emulsion, which blocks the nonprinting areas of the uniformly perforated screen, can be removed and the screen coated and exposed again.

The resolution in screen printing depends solely on the mesh width and the thread or wire thickness of the screen. The finer-meshed the screen is, the greater the resolution is. Since cylindrical screens with mesh widths of approx. 120/cm are used for high resolutions and such a mesh fabric is extremely unstable, high-resolution screens can be produced only with small effective printing widths (so-called working widths) of less than 60 cm if sufficient stability of the print roll is to be guaranteed.

SUMMARY OF THE INVENTION

The invention is therefore based on the problem of proposing a rotary screen printing cylinder which can be produced simply and cost-effectively and nevertheless permits the processing of large printing widths.

The invention is based on the idea that the printing areas of the screen are separated from one another by extensive nonprinting dead zones and these dead zones are designed so that the printing cylinder has sufficient stability.

The screen printing cylinder can be designed in the customary way as a uniformly perforated cylinder envelope, with reinforcing rings provided at certain intervals within the cylinder. This reinforced area forms the abovementioned dead zone and must of course not be exposed during subsequent patterning, i.e. of color-permeable design. If this measure results in a gap in the printed image, a second printing cylinder can be produced for printing in this gap in good register in a second printing operation and thus completing the printed image.

Another way of giving the printing cylinder stability is to make the cylinder screenlike only in the printing areas. This is of advantage in particular if the printed image involved is a relatively small one which repeats itself several times across the width of the cylinder, as is frequently the case in the processing of multiple printed sheets. The same naturally holds for a plurality of printed images to be applied in separate places, which might also be printed in different colors.

The screen cylinder is made in this case of an unperforated compact base material, such as metal, tin or plastic, which is provided in the zones intended to be color-permeable with the openings of predetermined diameter corresponding to the desired printed image. The screen holes can be burned with a laser or etched into the material. It is of course likewise possible to electroplate the screen. The zones provided with the color-permeable openings are separated from one another by the unperforated dead zones of base material.

A further inventive embodiment involves producing individual fine-meshed rotary screen printing cylinders with a small printing width and interconnecting these cylinders along their axis so that almost any web width of material to be printed can be processed. For this purpose the metallic end pieces of the printing cylinder, which constitute the connecting elements for driving the printing unit, are replaced on at least one side by an accordingly shaped connecting element, e.g. a flange. The first and last printing cylinders of such a row still of course have the corresponding known connection element for driving the machine.

However, a plurality of printing cylinders provided with a flange-shaped end piece on each side can be disposed between these two printing cylinders according to the invention. The nonprinting dead zones in the area of the flange elements can result in gaps in the printed image, as mentioned above, which can be filled in with the help of a second printing cylinder.

An advantage of this embodiment is that the individual printing cylinders can still be produced by standard machines in the customary manner so that there are no additional costs for elaborate machine change-overs.

However applications are also conceivable for which an undetachable connection is advantageous. In this case the end pieces can be for example simple pipe elements which are firmly welded together.

According to a further embodiment, the connecting elements between the screen areas can also be manufactured from one piece, so that one basically has only one screen printing cylinder whose screen area is interrupted by the supporting connecting elements at certain places.

The individual printing cylinders can of course be designed as desired. For example one of the cylinders can be made of a solid material which is screenlike only in certain zones, while another is made of a mesh fabric patterned in the usual fashion.

The invention accordingly offers the possibility of producing a rotary screen printing cylinder of any axial length which has high stability independently of the size of the openings of the printing screen area due to the reinforced zones. In this way the printing zones of the screen can be adapted optimally to the requirements, e.g. in terms of resolution.

The separation into printing color-permeable zones and color-impermeable dead zones further offers the advantage that several colors can be printed side by side in one printing operation. If the reinforcement of the printing zones is formed by separate elements, such as reinforcing rings or flanges, these elements can serve simultaneously as color dividers which prevent the colors from blending.

The inventive rotary screen printing cylinders can furthermore be used especially advantageously in security printing. In the production of bank notes it is frequently necessary to print individual, spaced paper areas with special inks, which contain e.g. fluorescent or magnetic substances or iridescent pigments. Just one printing cylinder can be used according to the invention for applying these different color areas. For this purpose the cylinder is divided into a plurality of color-permeable zones which are separated by accordingly designed color-impermeable dead zones along the entire cylinder periphery. The color-permeable zones are patterned in accordance with the desired printed image and subsequently brought in contact with the particular color.

Instead of colors one can of course also print lacquers or adhesives in a certain pattern. For example it is conceivable to apply one or more effect colors and a locally limited layer of lacquer or adhesive to the antifalsification paper in one printing operation. A further security element, such as a hologram or interference layer element, could subsequently be fastened in the area of the adhesive layer.

Further embodiments and advantages of the invention will be explained with reference to the drawings.

DETAILED DESCRIPTION OF THE PREFERRED EMBODIMENTS

Figure 1:
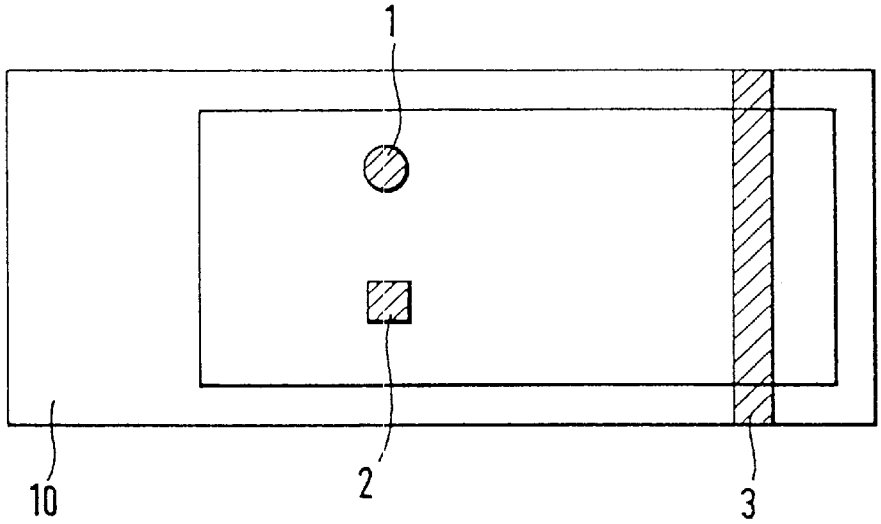
FIG. 1 shows a paper of value with various printed features.

FIG. 1 shows paper of value 10, e.g. a bank note made of antifalsification paper, which has several security features 1, 2, 3. Features 1, 2 are printed features which were applied by screen printing. The inks used for printing these features 1, 2 are subject to no restriction in terms of composition and can contain feature substances, such as fluorescent or magnetic pigments, along with coloring pigments, or only the feature substances dispersed or dissolved in a binder. It is equally conceivable to use iridescent interference layer pigments which show a striking viewing angle-dependent color effect. Security feature 3, however, can be a multilayer element, such as a hologram or coated plastic thread, which is fastened to the antifalsification paper film with the help of a layer of adhesive or lacquer. The antifalsification paper can of course also have other security features, such as an embedded security thread or the like.

Figure 2:
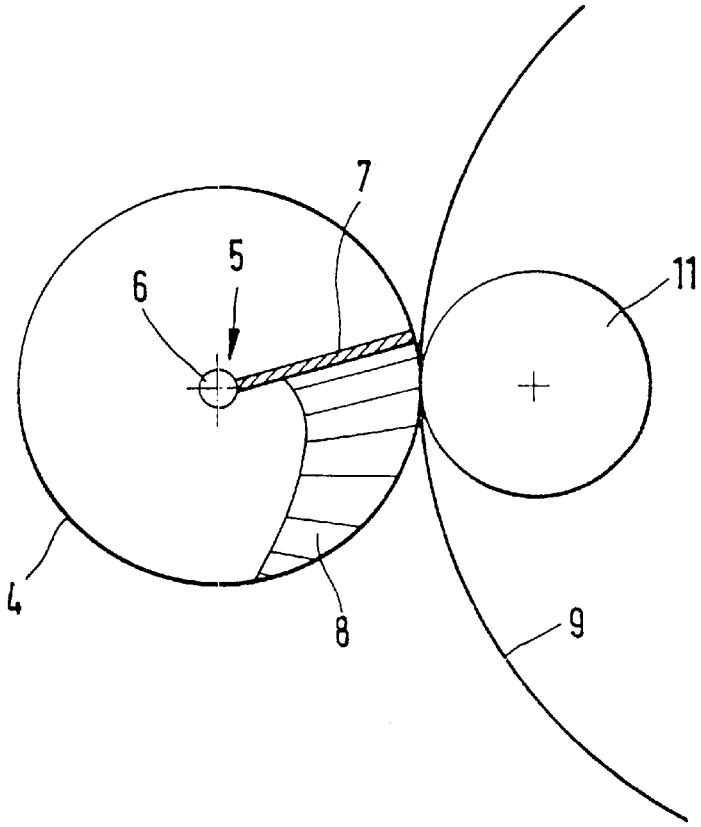
FIG. 2 shows a schematic arrangement of print rolls for screen printing.

FIG. 2 illustrates the principle of screen printing using rotary screen printing cylinders. A screen printing cylinder 4 is color-permeable only in the area of the printing pattern to be transferred, while the remaining part of the screen is color-impermeable. A squeegee 5 is fastened within the printing cylinder 4, and consists generally of wooden or metal rod 6 extending in the axial direction of the cylinder 4 and a rubber or plastic strip, the actual squeegee element 7, fastened thereto in the radial direction. The squeegee element 7 presses ink 8 likewise introduced inside the cylinder 4 through the permeable openings in the cylinder 4. The ink is transferred to the material 9 to be printed, e.g. paper or plastic, in the area of a back pressure roll 11.

Figure 3:
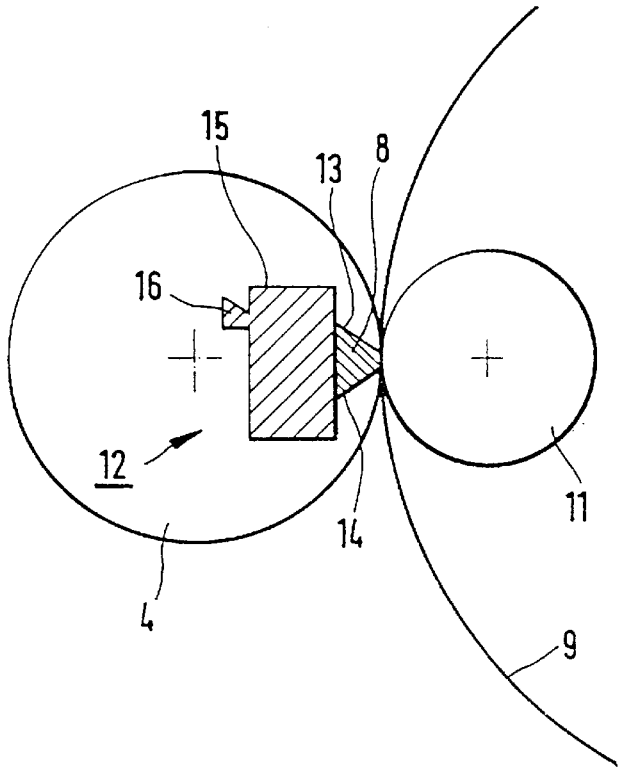
FIG. 3 shows a sketch of a screen printing cylinder with a chamber-type squeegee, in cross section.

Instead of strip-shaped squeegee 5 one can also use a chamber-type squeegee 12 whose mode of operation is illustrated in FIG. 3. The chamber-type squeegee 12 consists of two rubber or plastic lips 13, 14 which lie against the inside of screen printing cylinder 4 and press ink 8 through the screen openings. The opposite ends of the lips 13, 14 are connected with a sealed housing 15 into which ink 8 is pumped via a valve 16 in an electronically regulated fashion.

Figure 4:
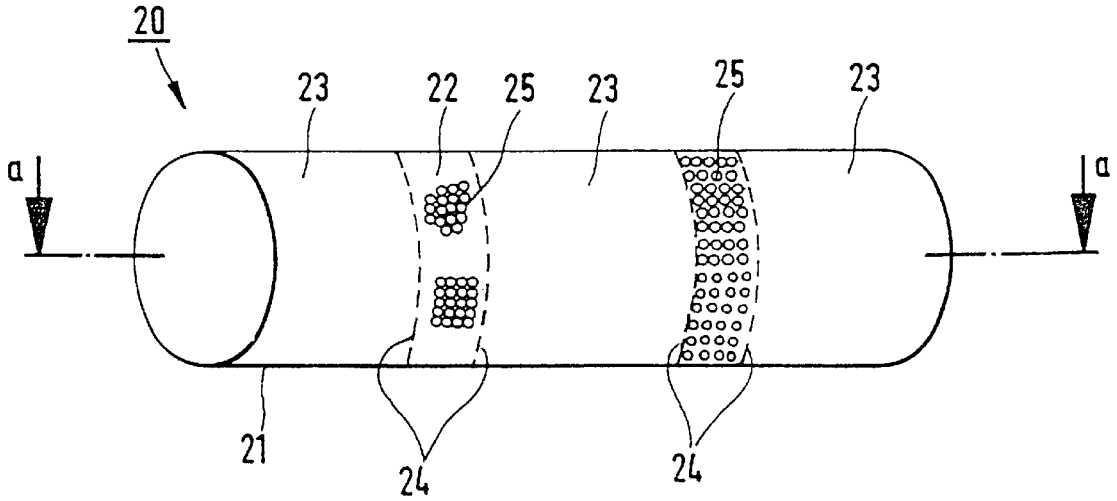
FIG. 4 shows a first variant of the inventive screen printing cylinder.

FIG. 4 schematically shows a patterned rotary screen printing cylinder 20 pursuant to the present invention in plan view for applying the inks for areas 1, 2 shown in FIG. 1 and for the adhesive layer of element 3 in just one printing operation. Cylindrical surface 21 is subdivided along its rotation axis a into color-permeable or at least partly color-permeable zones 22 and color-impermeable dead zones 23 disposed therebetween, which in each case extend over the cylindrical surface in rotationally symmetric fashion. Zones 22, 23 are defined solely by the presence or absence of color-permeable openings in the cylindrical surface 21. Dash lines 24 are therefore provided only for clarity's sake to define the zones and are not present on the cylinder 20.

The color-permeable openings in areas 25 constitute the actual screen since only through them can color pass onto the material to be printed. The color-permeable openings can come about in different ways. One can use for the screen cylinder 20 for example a compact, i.e. as yet unperforated, plastic, metal or tin material in which the desired openings are provided by an electronically controlled laser. This has the advantage that the size, i.e. diameter, of the openings can be different, so that the resolution and color application can be varied for different printed images, although they are located on one printing cylinder. In this variant the dead zones 23 consist of unperforated solid material, which gives the printing cylinder 20 sufficient strength so that no additional reinforcing elements are necessary in this area.

The same holds if the cylinder 20 is produced by etching techniques or electroplating. In the etching technique a metal sheet, for example, is provided with an acidproof coating which covers all areas except the screen openings to be produced. The coated sheet is then put in a caustic liquid which attacks and dissolves the exposed uncoated metal surfaces.

Figure 5:
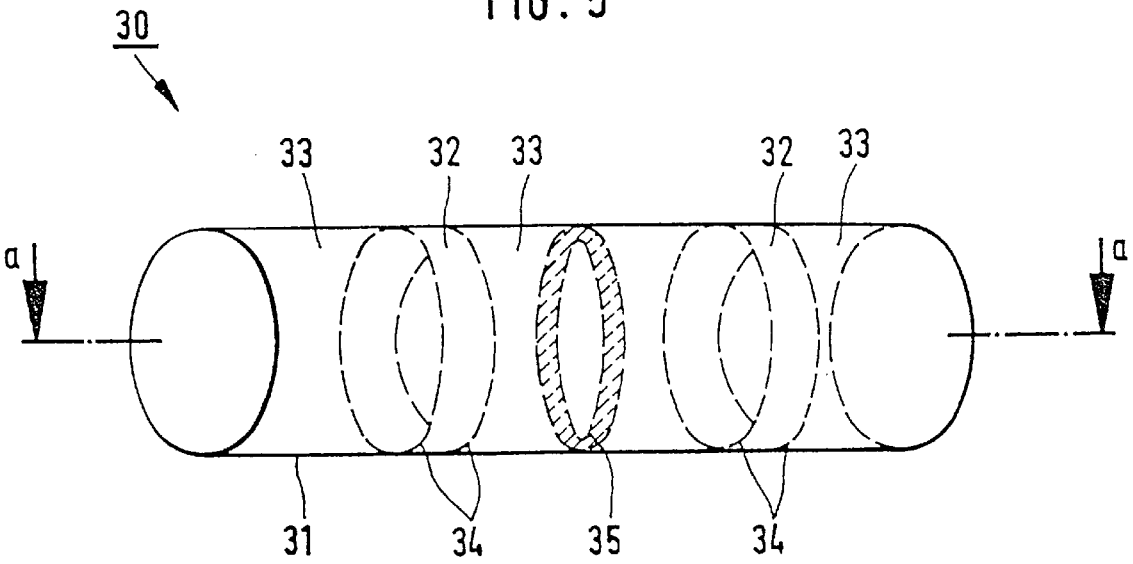
FIG. 5 shows a second variant of the inventive screen printing cylinder.

Alternatively one can use a regular mesh fabric, preferably of metal wire, in the usual way. The mesh aperture is generally about 1.5 to 2.5 times the wire diameter. FIG. 5 shows a printing cylinder 30 whose surface is made of a regular mesh fabric, which is omitted in the drawing for reasons of clarity. The cylindrical surface 31 of the cylinder 30 is likewise subdivided along the rotation axis a into color-permeable zones 32 and color-impermeable dead zones 33. The zone boundaries are again indicated by dash lines 34. The dead zones 33, which likewise have openings in this embodiment, are provided with reinforcing elements, reinforcing rings 35 here, inside the cylinder 30 to increase the stability of the cylinder 30. These elements 35 can be worked directly into the material or glued on. During subsequent photographic patterning of the cylindrical surface 31, the entire cylinder 30 is coated with a photographic emulsion and exposed at least partly in the zones 32. The exposed areas are finally washed away so that the mesh fabric is uncovered and becomes color-permeable in these places.

Figure 6:
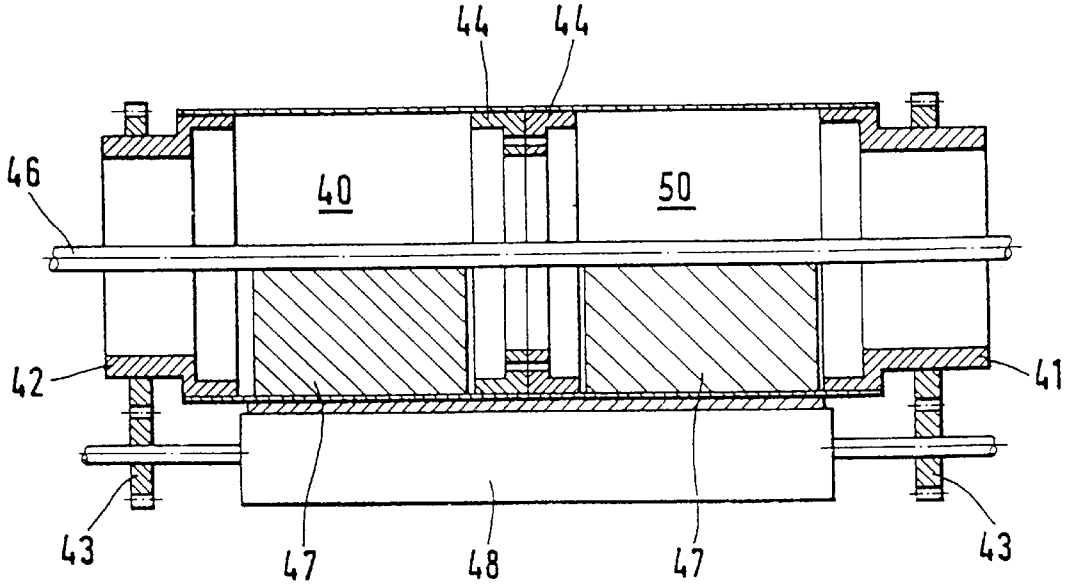
FIG. 6 shows a longitudinal section through a further variant according to the invention.

FIG. 6 shows a further embodiment of the invention. It shows a longitudinal section through two flanged-together rotary screen printing cylinders 40, 50 according to the invention. On the side facing the printing unit, cylinders 40, 50 have conventional end pieces 41, 42 that ensure the connection to a driving system 43 of the printing unit. The end pieces 41, 42 are of course also present in the previously-described embodiments, even if not shown in the figures. The opposite ends of the screen cylinders 40, 50 are provided with flange elements 44 for the interconnecting cylinders 40, 50. The flange elements 44 can be equipped with a washer or guide groove to guarantee that the cylinders are brought together in exact register. Further printing cylinders can be disposed between the cylinders 40, 50 as required, being provided with flange elements 44 on each side so they can be connected with the cylinders 40, 50 in the axial direction. The squeegee 45 consists in this case of one squeegee rod 46 common to all the cylinders 40, 50, which is provided in the area of the individual cylinders 40, 50 with actual squeegee elements 47 which guarantee the ink transfer to the material to be printed. The same squeegee assembly can of course be used in the embodiment described with reference to FIG. 5. A back pressure roll 48 is also arranged to extend over the entire printing width. In the flange zone the printing screen consisting of the individual screens 40, 50 can be supported by supporting rolls in the printing unit.

Instead of flange elements, which permit an easily detachable connection, one can also use at any desired place other connecting elements which are less easily, or not at all, detachable. It is conceivable, for example, to provide one or more of the individual printing cylinders with different end pieces. If, for example, two of four individual cylinders are to be interconnected undetachably, a one-piece connecting element can be provided therebetween, while the connecting elements with the other two individual cylinders might be formed as flange elements. In this case the first two screen elements, which are connected by the one-piece connecting element, are expediently connected before the screens are patterned since the connecting element manufactured from one piece serves both screens as a stabilizing end piece. The reverse procedure, producing and patterning the screens singly without the common connecting element and subsequently inserting the connecting element between the screen elements, might also be appropriate in some cases, however, e.g. if the existing machine equipment for producing the screens is not designed for the length of the connected screen elements.

All these embodiments have the great advantage that the individual screen can be adapted specifically to the required printing quality and the necessary printing width is obtained by connecting a plurality of individual printing cylinders, the connecting elements serving simultaneously as supporting elements for the assembled printing cylinder. It is thus possible using the invention to produce screen printing cylinders with a working width of 80 cm or more although screens with mesh widths of approx. 120/cm are used.

Due to the possibility of combining any printing cylinders, it is also conceivable to assemble cylinders from individual screens of different mesh widths. One can likewise combine printing cylinders produced in different ways.

The invention further makes it possible to print several colors at the same time if the color-permeable zones are each brought in contact with a different ink. One must of course make sure the different inks do not mix. If reinforcing elements, such as reinforcing rings or flange elements, are provided in the nonprinting dead zones, they can function simultaneously as color dividers. In the embodiments of FIGS. 5 and 6 it is therefore readily possible to form separate screen chambers in which the color can be introduced e.g. by means of separate electric pumping systems.

It is also possible to print different colors simultaneously in the variant of FIG. 4 by providing each color-permeable zone 22 with a separate chamber-type squeegee.

The invention can furthermore be used favorably wherever colors are printed very finely and over great widths, such as in the printing of plastic films which are subsequently cut into narrow bands with a width in the range of a few millimeters and embedded in antifalsification paper as security threads. Such threads very frequently have microwriting which must be printed legibly on the wide film sheet at suitable intervals. Up to now this could only be done by rotogravure, which increased the production costs in view of the complicated and elaborate printing plate production.

The invention can naturally also be used advantageously for printing security documents made of plastic, such as identity cards.

I claim:

1. A rotary screen printing cylinder, comprising:

a cylindrical screen having a circular cross-section and a cylindrical surface with at least one color permeable zone provided with color-permeable openings;

a squeegee disposed within the screen; and two end pieces respectfully connected to opposite ends of the screen as an extension of the cylindrical surface, one of the end pieces being formed so as to stabilize the screen printing cylinder and being further formed as means for connecting the one end piece with another screen printing cylinder.

2. The rotary screen printing cylinder of claim 1, wherein the connecting element is a flange element.

3. The rotary screen printing cylinder of claim 1, wherein the color permeable openings have different diameters.

4. A rotary screen printing cylinder, comprising:

a cylindrical screen having a circular cross-section and a cylindrical surface with a fabric of predetermined mesh width;

a squeegee disposed within the screen;

two end pieces respectively connected to opposite ends of the screen as an extension of the cylindrical surface; and arranging at least one reinforcing element on an entire inner circumferential surface of the screen to divide the screen into two screen chambers and so as to stabilize the screen printing cylinder, the reinforcing element being configured to occupy only a portion of the circular cross-section and axial extension of the screen.

5. A system comprising a plurality of axially connected rotary screen printing cylinders, each of the rotary screen printing cylinders comprising a cylindrical screen having a cylindrical surface with at least one color-permeable zone provided with color-permeable openings, a squeegee disposed within the screen, and two end pieces respectively fastened to opposite ends of the screen as an extension of the cylindrical surface, at least one of the end pieces of the rotary screen printing cylinder being configured as a connecting element, the connecting elements of each rotary screen printing cylinder of the system being cooperatively engageable to interconnect the rotary screen printing cylinders.

6. The system of claim 5, wherein at least one of the connecting elements is a flange element.

7. The system of claim 5, wherein at least one of the connecting elements is a single piece.

8. The system of claim 5, and further comprising a squeegee rod common to all the screen printing cylinders and arranged to extend axially thereto, and a squeegee element fastened to the rod in a region of each of the screen printing cylinders.

9. The system of claim 5, wherein the squeegee is a chamber-type squeegee.

10. The system of claim 5, wherein the color-permeable openings have different diameters.

11. The system of claim 5, wherein at least one of the screen printing cylinders is made of an unperforated material provided with openings only within the at least one color-permeable zone.

12. The system of claim 5, wherein at least one of the screen printing cylinders is made of a mesh fabric of predetermined mesh width.

13. A method for producing a system of rotary screen printing cylinders, comprising the steps of:

providing a plurality of rotary screen printing cylinders, each having a cylinder screen with color-permeable openings in at least one zone of a cylindrical surface of the screen;

disposing a squeegee within each screen and fastening two end pieces respectively to the ends of each screen as an extension of the cylindrical surface; and forming at least one end piece of each rotary screen printing cylinder as a connecting element for interconnecting the rotary screen printing cylinders of the system along their axis.

14. The method of claim 13, including forming at least one connecting element as a flange element.

15. The method of claim 13, including forming at least one connecting element as one piece.

16. A method for producing a rotary screen printing cylinder, comprising the steps of:

providing a cylindrical screen having a circular cross-section and formed of a mesh fabric of predetermined mesh width with color-permeable openings in at least one zone of a cylindrical surface of the screen;

disposing a squeegee within the screen;

fastening two end pieces respectively to opposite ends of the screen as an extension of the cylindrical surface; and providing at least one reinforcing element on an entire inner circumferenced surface of the screen so as to occupy only a portion of the circular cross-section and axial extension of the screen for subdividing the screen into two screen chambers.

17. A method for producing a rotary screen printing cylinder, comprising the steps of:

providing a cylindrical screen having a circular cross-section and with color-permeable openings in at least one zone of a cylindrical surface of the screen;

disposing a squeegee within the screen;

fastening two end pieces respectively to opposite ends of the screen as an extension of the cylindrical surface; and forming at least one of the end pieces as a connecting element having means for connecting the at least one end piece to another screen printing cylinder.

18. The method of claim 17, including fastening the end piece in the form of a flange element at the end of the screen.

19. A method for printing security paper, comprising the steps of: providing a plurality of axially connected rotary screen printing cylinders, each having a cylindrical screen having a cylindrical surface with at least one zone provided with color-permeable openings, a squeegee disposed within the screen, and two end pieces respectively fastened to opposite ends of the screen as an extension of the cylindrical surface, at least one of the end pieces of each rotary screen printing cylinder of the system being configured as a connecting element, the connecting elements being cooperatively engageable to interconnect the rotary screen printing cylinders; connecting together a at least two of the rotary screen printing cylinders; supplying ink to an interior of the printing cylinders; pressing the ink through the openings of the screens with the squeegee; and printing the security paper.

* * * * *